US008596632B2

(12) United States Patent
Silberbauer et al.

(10) Patent No.: US 8,596,632 B2
(45) Date of Patent: Dec. 3, 2013

(54) METHOD AND DEVICE TO PRODUCE PRINTED ITEMS

(75) Inventors: Guenther Silberbauer, Uerkheim (CH); Konrad Boos, Stettfurt (CH)

(73) Assignee: Mueller Martini Holding AG, Hergiswil (CH)

( * ) Notice: Subject to any disclaimer, the term of this patent is extended or adjusted under 35 U.S.C. 154(b) by 413 days.

(21) Appl. No.: 12/897,513

(22) Filed: Oct. 4, 2010

(65) Prior Publication Data

US 2011/0079159 A1 Apr. 7, 2011

(30) Foreign Application Priority Data

Oct. 5, 2009 (EP) ..... 09405174

(51) Int. Cl.
*B65H 39/00* (2006.01)

(52) U.S. Cl.
USPC ..... 270/52.19; 270/52.14; 270/52.16; 270/52.2

(58) Field of Classification Search
USPC ..... 270/52.14, 52.16, 52.18, 52.19, 52.2, 270/52.26, 58.29
See application file for complete search history.

(56) References Cited

U.S. PATENT DOCUMENTS

| | | | | |
|---|---|---|---|---|
| 5,114,128 | A * | 5/1992 | Harris et al. | 270/1.03 |
| 5,634,633 | A * | 6/1997 | Graushar | 270/58.05 |
| 5,678,813 | A * | 10/1997 | Osako et al. | 270/52.16 |
| 6,224,048 | B1 * | 5/2001 | Motamed | 270/52.02 |
| 6,257,566 | B1 * | 7/2001 | Dooley | 270/52.18 |
| 7,475,523 | B2 * | 1/2009 | Graushar et al. | 53/397 |
| 7,568,685 | B2 * | 8/2009 | Silberbauer | 270/58.07 |
| 7,665,720 | B2 * | 2/2010 | Mori et al. | 270/52.16 |
| 7,762,385 | B2 * | 7/2010 | Maeder et al. | 198/778 |
| 2007/0069442 | A1 * | 3/2007 | Abegglen | 270/52.14 |

FOREIGN PATENT DOCUMENTS

| | | | |
|---|---|---|---|
| DE | 27 40 320 | A1 | 3/1978 |
| EP | 1 197 456 | A1 | 4/2002 |
| EP | 1 279 522 | A2 | 1/2003 |
| EP | 1 348 573 | A2 | 10/2003 |
| EP | 1 559 573 | A1 | 8/2005 |
| EP | 1 762 525 | A1 | 3/2007 |
| WO | WO-2007/085101 | A1 | 8/2007 |

OTHER PUBLICATIONS

European Search Report Issued in Priority Application No. EP 09405174.5 filed on Oct. 5, 2009.

* cited by examiner

*Primary Examiner* — Leslie A Nicholson, III
(74) *Attorney, Agent, or Firm* — Venable LLP; Robert Kinberg

(57) ABSTRACT

A method and device to produce printed items having at least one printed product and a supplement. The device includes a gathering device with a gathering section such that the gathering section includes a continuously circulating conveyor. A printer is also provided to produce the printed products wherein the printed products include a single page or partial block stacks. The device further includes feeders to supply the printed products to the conveyor and at least one supplement feeder arranged between two of the feeders to feed at least one supplement to the circulating conveyor.

13 Claims, 5 Drawing Sheets

METHOD AND DEVICE TO PRODUCE PRINTED ITEMS

CROSS-REFERENCE TO RELATED APPLICATION

This application claims the priority to European Patent Application No. 09405174.5, filed on Oct. 5, 2009, the subject matter of which is incorporated herein by reference in its entirety.

BACKGROUND

The subject matter of the application relates to a method for producing printed items such as book blocks, books, booklets, magazines and the like. Such items may include a single page printed product, multipage printed products, as well as inserted supplements. The printed products and the supplements are gathered selectively along a gathering section to form loose book blocks, wherein several feeders are arranged along the gathering section for supplying the printed products to receiving locations which follow each other successively along a continuously circulating conveyor.

When producing bound printed items, for example, but not limited to, book blocks, books, telephone books, paperback books, magazines or similar products, different semi-finished products such as signatures or individual printed sheets are normally produced ahead of time during a first production step. The different semi-finished products are then gathered with the aid of a gathering machine into loose book blocks. Subsequently, they are adhesive-bound, wire-stitched or thread-stitched and, if applicable, provided with a cover. In addition, pre-addressed reply cards, CDs/DVDs, illustrations, bags or similar flat products can also be inserted into the printed products, either loosely or adhering to a specific sheet or signature.

Furthermore, digital printing presses for sequentially printing all pages of a book block on paper pulled from a roll are known. These pages are then stacked to form a loose book block and are subsequently bound with the aid a binding machine, arranged downstream in line. Usually, the width of the paper web is multiple times that of the printed sheets, so that the paper web is cut or folded in a longitudinal direction after the printing and is finally also cut in a transverse direction. The resulting printed sheets are then folded and stacked to form a complete, loose book block. Depending on how the folding or cutting takes place, loose book blocks produced in this way include individual pages or folded signatures.

Alternatively, it is also possible to print on individual sheets, already cut to format size, and to stack these individual sheets in the above-described manner to form loose book blocks. In order to insert supplements between the pages of book blocks produced in this way, it is known to open up the book blocks in the loose or bound condition with the aid of a sword and then insert the supplements at those locations. However, this method has the disadvantage that the printed products cannot be opened to the precise page or signature and the supplements can thus not be inserted at the desired location.

According to European patent document EP 1 559 573 A1, a supplement is supplied in a printing press to a sheet or signature prior to the stacking, wherein the supplement rests on the sheet or signature, or is attached to it by adhesive, or adheres to it because of electrostatic attraction. With this method, supplements can be supplied precisely to the desired sheet or signature, but the supplement is in danger of being displaced during the stacking, relative to the signature and/or the stack.

SUMMARY

It is an object to provide a method and a device to permit a precise feeding of supplements to the desired pages of digital and/or sequentially printed book blocks, so that the supplements may be positioned accurately with respect to the printed sheets.

According to one embodiment of the invention, there is provided a method to produce printed items each having at least one printed product and a supplement, comprising: sequentially printing the printed products with at least one printer, the printed products including at least one of a single page or partial block stacks; continuously circulating a conveyor with uniformly spaced apart receiving locations that follow each other; supplying by a plurality of feeders arranged along a gathering section of the circulating conveyor the printed products from the printer to the uniformly spaced apart receiving locations; and selectively gathering the printed products and the supplements along the gathering section to form loose book blocks.

According to another embodiment of the invention, there is also provided a device to produce printed items having at least one printed product and a supplement, comprising: a gathering device with a gathering section, the gathering section including a continuously circulating conveyor; a digital printer to produce the printed products, the printed products including a single page or partial block stacks; feeders to supply the printed products to the conveyor; and at least one supplement feeder arranged between two of the feeders to feed at least one supplement to the circulating conveyor.

According to yet another embodiment of the invention, there is also provided a method to produce printed items having at least one printed product and supplement, comprising: printing the at least one printed product with a printer, the printed products each including a single page or partial block stacks; feeding the printed products from the printer with feeders to a circulating conveyor; supplying a supplement with at least one supplement feeder arranged between two of the feeders to the circulating conveyor; and selectively gathering the printed products and supplement along the gathering section to form loose book blocks.

According to another embodiment of the invention, sequentially imprinted products are supplied in the form of at least one of individual sheet stacks and/or partial book block stacks to receiving locations or receptacles along the gathering section of the conveyor, using at least one feeder that is connected to a digital printing press. Other types of printing presses may also be used in place of a digital printing press for producing sequentially printed partial book block stacks, such as for example, a band printer.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
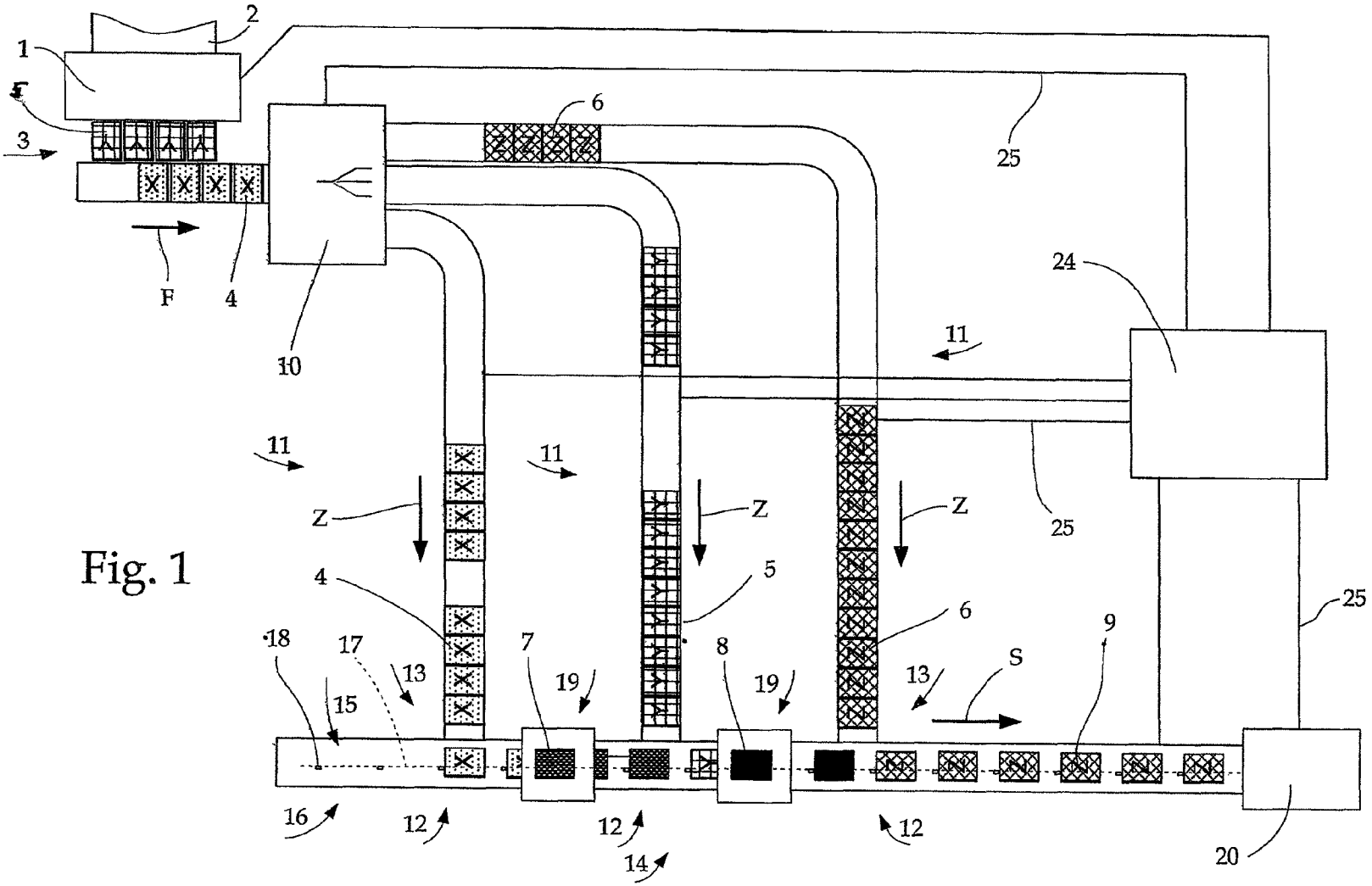
FIG. 1 is a schematic representation of a device according to the invention, having a multiple stack producing device arranged downstream of a digital printing machine.

FIG. 1 shows a schematic representation of a device for producing book blocks, books, telephone books, paperback books, magazines or similar products which are printed on using at least one digital printing press 1 and which are subsequently bound to form a complete printed item or product. The printed item may be single pages, multiple pages, or partial block stacks, together with inserted supplements. A digital printing press 1 may be a machine which sequentially prints pages of printed products, wherein the page content is available in the form of, for example, electronically stored data.

For the embodiment shown in FIG. 1, a paper web 2, unwound from a roll, is printed on by the digital printing press 1. The web 2 is cut in a longitudinal direction into four strips of the same width. The strips are subsequently cut transverse into sections and the sections are then gathered into single page and/or partial book block stacks 4, 5, 6 inside the stacking devices 3.

A series of identical partial block stacks 4, 5, of a specific type of individual sheets is thus formed, wherein these sheets are printed in the correct sequence. The identical partial block stacks 4, 5, 6 of a different and/or additional type are subsequently printed and stacked in the same way. This operation is continued until respectively one series is printed and stacked of each type of partial block stack 4, 5, 6. Supplements 7, 8 are supplied to an incomplete book block conveyed along a gathering section 14. The number for the series of different partial block stacks 4, 5, 6 is higher by 1 than the number of locations where the supplements 7, 8 are supplied to an incomplete book block.

For the example shown in FIG. 1, two types of supplements 7, 8 are supplied between three different partial block stacks 4, 5, 6. The completed partial block stacks 4, 5, 6 are supplied in conveying direction F to a diverter 10 which then diverts these stacks to respectively one of the conveying paths 11 for which they are intended. Along the conveying path 11, the partial block stacks 4, 5, 6 are conveyed in a feeding direction Z to a location behind the partial block stacks 4, 5, 6 already positioned at the end of the respective conveying paths 11 and/or are jammed up against these stacks.

A clocked insertion device 13 triggers a feeder 12 to transfer the partial block stacks 4, 5, 6 with synchronized clocking to a gathering section 14. The gather section 14 has uniformly spaced-apart receiving locations 15 of a conveyor 16 moving continuously in a gathering direction S. The receiving locations 15 may be pushers 18, for example, mounted on a circulating traction device 17 such as a chain. The pushers move the loose book blocks 9 during and after the gathering operation by pushing them along inside a gathering channel. However, the receiving locations 15 may also be rotating tables on which the partial block stacks 4, 5, 6 are deposited. Further, the receiving locations 15 may be clamps for clamping in the partial stack blocks 4, 5, 6 or the receiving locations 15 may also take the form of a saddle-shaped conveying chain in a gathering and wire-stitching machine on which opened partial block stacks 4, 5, 6 are deposited straddling.

For the production of the printed products or items, additional feeders 12, as well as supplement feeders 19, are arranged along the gathering section 14. The feeders 12 and 19 respectively supply the partial block stacks 4, 5, 6 and the supplements 7, 8. The partial block stacks 4, 5, 6 and the supplements 7, 8 are gathered optionally along the gathering section 14 to form loose book blocks 9. At least two individual sheets and/or partial block stacks 4, 5, 6 are supplied via respectively one feeder 12 to the conveyor 16 and/or the receiving locations 15 to form a printed product or item.

At least one supplement 7, 8 is fed with a supplement feeder 19 to the at least partially formed book block 9. The supplement 7, 8 may be fed on top of a partial block stack 4, 5, 6. The supplement feeder 19 may be arranged between at least two feeders 12 that supply single pages, multiple pages, and/or partial-block stacks 4, 5, 6. If the supplement 7, 8 is subsequently bound together with the book block 9 inside a binder 20, this supplement 7, 8 may be deposited loosely onto the top of a partial block stack 4, 5, 6 of the partially formed book block 9. In the alternative, if the supplement 7, 8 is to be attached to the center of the flat, topmost page of a partial stack 4, 5, 6 of a partially formed book block 9, the supplement 7, 8 may be deposited such that it adheres to the surface. The supplement 7, 8 may thus be attached with an adhesive and/or glue to the partially formed book block 9 or may adhere temporarily by electrostatic attraction to the partially formed book block 9.

At least one of the feeders 12 supplies products, printed sequentially by a digital printer 1, as a single sheet and/or partial block stack 4, 5, 6 to the receiving locations 15 along the gathering section 14 of the conveyor 16. While moving past the feeders 12 and the supplement feeders 19, each receiving location 15 is supplied by each of the feeders 12 and the supplement feeders 19 with respectively one partial stack 4, 5, 6 or a supplement 7, 8 in the correct sequence. Accordingly, each receiving location 15 contains a complete book block 9 when it reaches the end of the conveyor 16.

The book block may then be conveyed further to a binder 20 where the complete book blocks 9 are adhesive-bound, spiral-bound, wire-stitched or thread-stitched. For the coordination and control of the method steps, a control device 24 may be coupled via lines 25 to the digital printer 1, the diverter 10, the conveying paths 11 to the feeders 12, the conveyor and the binder 20. A plurality of control units may also be provided instead of a central control unit 24, wherein these are coupled to each other via lines 25.

Figure 2:
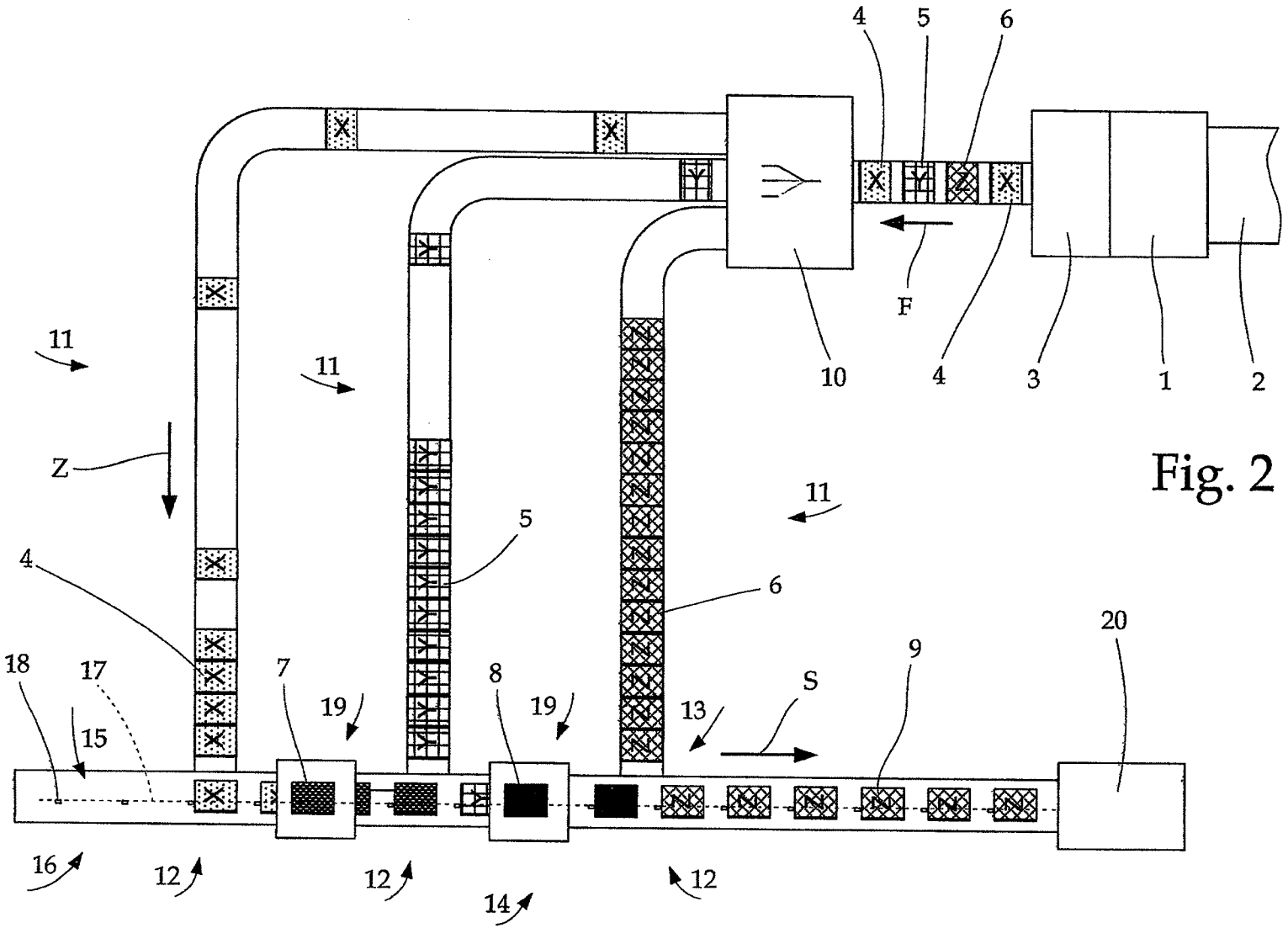
FIG. 2 is a schematic representation of a device according to the invention for which a single stack producing device single stacker is arranged downstream of a digital printing machine.

As compared to the digital printer 1 shown in FIG. 1, the digital printer 1 for the arrangement shown in FIG. 2 includes only one stacking device 3 in which individual partial block stacks 4, 5, 6 are formed sequentially and are then distributed, matched by type, via the diverter 10 to the feeders 12. The following gathering process takes place in the same way as the previously described process.

Figure 3:
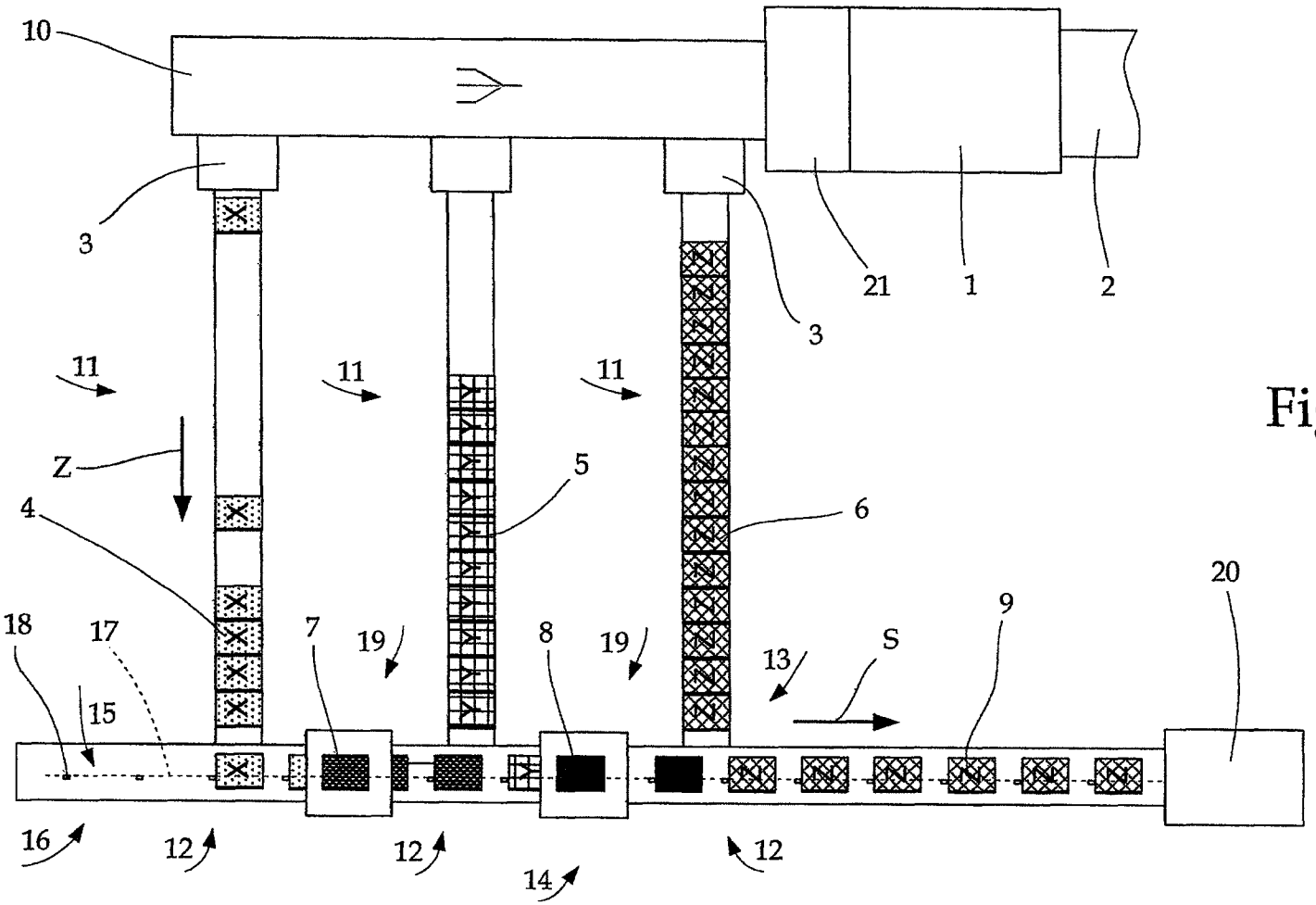
FIG. 3 is a schematic representation of a device according to the invention for which a plurality of stacking devices are arranged downstream of a the digital printing press including a folding device.

With an arrangement as shown in FIG. 3, a digital printer 1 prints on the paper web 2 which is folded in a longitudinal direction and/or lateral direction in a folding device 21 and is cut. The folded signatures are guided over the diverter 10 and may be stacked to form partial block stacks 4, 5, 6 in the stacking devices 3 assigned to specific partial block stacks 4, 5, 6. The following operations, in turn, correspond to those described in the above.

Figure 4:
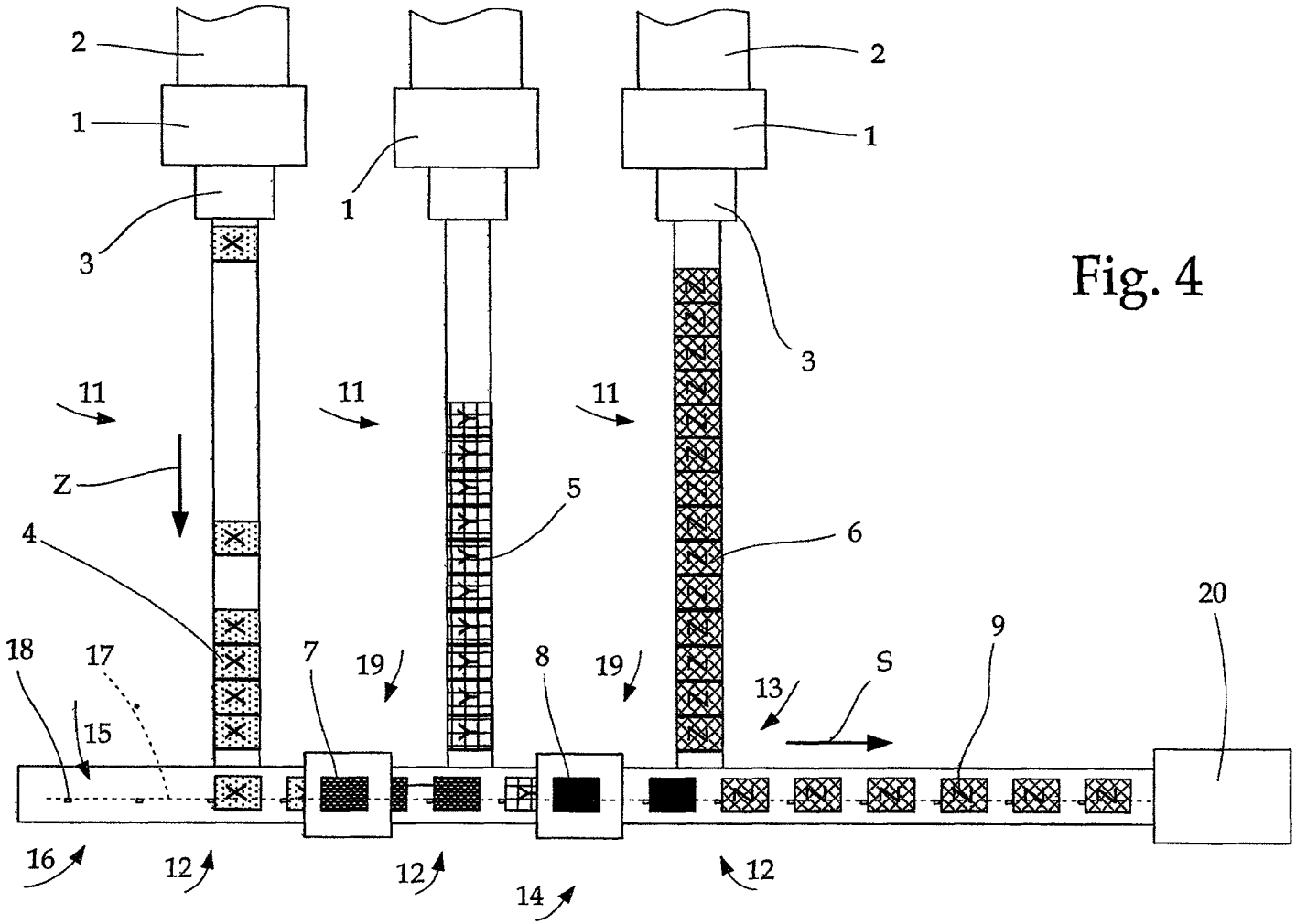
FIG. 4 is a schematic representation of a device according to the invention for which a separate stacking device is arranged downstream of each of a plurality of parallel-arranged digital printing machines.

FIG. 4 shows a conveyor 16 which is supplied by a plurality of feeders 12 with partial block stacks 4, 5, 6 arriving from a plurality of digital printers 1. Each of these digital printers 1 may represent a separate type for the partial block stacks 4, 5, 6. The subsequent operations again may correspond to those described in the above.

Figure 5:
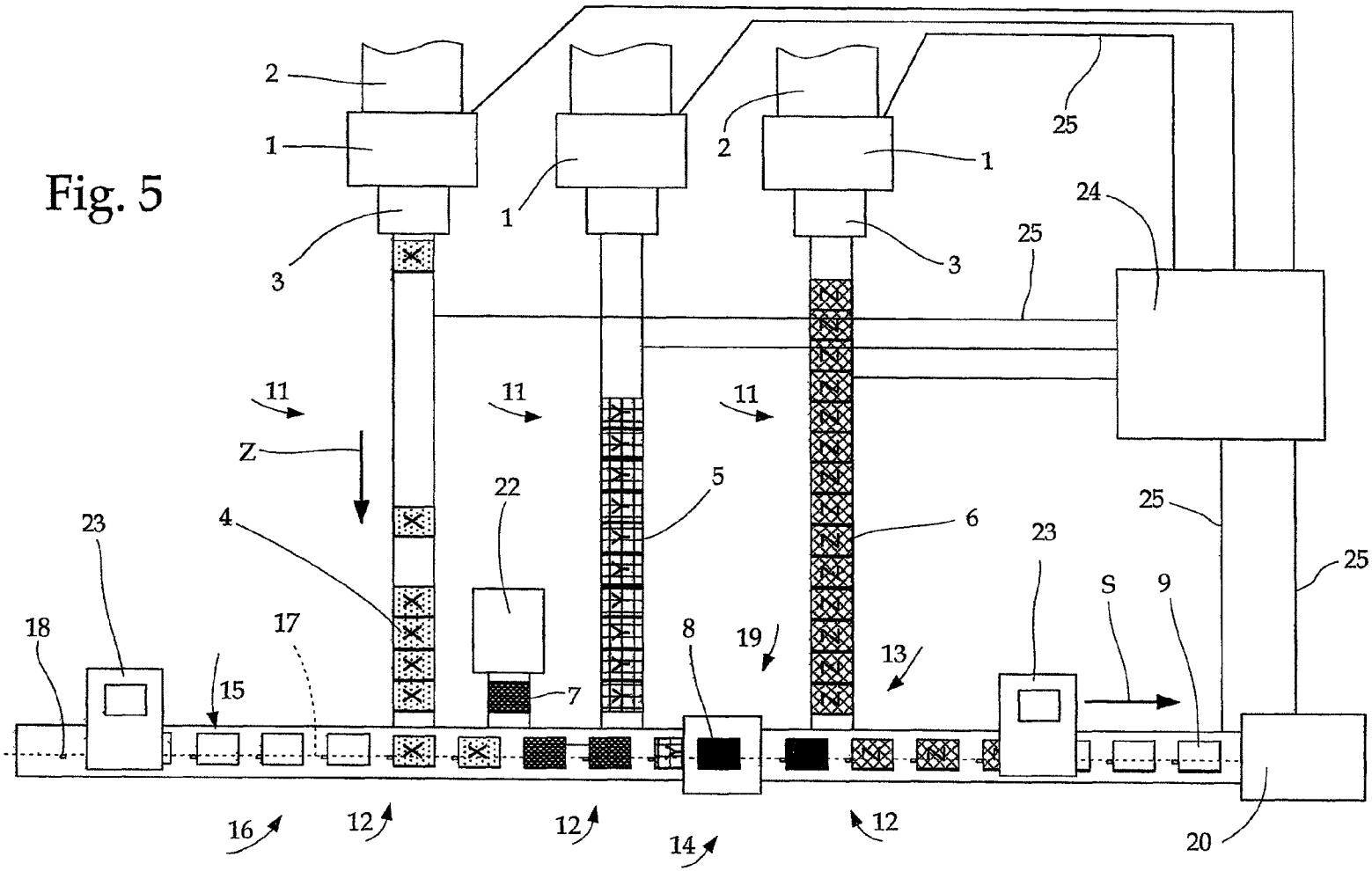
FIG. 5 is a schematic representation of an alternative device according FIG. 4, showing a plurality of parallel-arranged digital printing presses with a separate stacking device arranged downstream of each printing press.

According to another embodiment shown in FIG. 5, the supplements 7, 8, produced by a digital printer 22, may also be supplied by a feeder 12 to an at least partially formed book block 9. In addition, sheet feeders 23 for supplying conventional printed sheets, e.g. produced with the offset printing method, may be arranged at optional locations along the gathering section 14. This may allow sheets with changing print to be printed digitally in-line while the remaining sheet types may be produced on a faster, conventional printer (ahead of time).

It will be understood that the above description of the present invention is susceptible to various modifications, changes and adaptations, and the same are intended to be comprehended within the meaning and range of equivalents of the appended claims.

What is claimed is:

1. A method to produce printed items each having at least one printed product and a supplement, comprising:

sequentially printing pages of printed products with at least one digital printer;

continuously circulating a conveyor with uniformly spaced apart receiving locations that follow each other;

supplying the printed products from the digital printer as individual sheets or partial block stacks to the uniformly spaced apart receiving locations by respective feeders arranged along a gathering section of the circulating conveyor to form an at least partially formed book block; and supplying at least one supplement to one of the at least partially formed book blocks on the circulating conveyor by a supplement feeder arranged along the gathering section of the circulating conveyor between two of the respective feeders, wherein the receiving locations at an end of the gathering section contain loose book blocks formed of selectively gathering of supplied printed products and supplements used to form the printed items.

2. The method according to claim 1, further comprising forming the partial block stacks with individual sheets or folded signatures.

3. The method according to claim 1, wherein the supplying the at least one supplement includes supplying the at least one supplement on top of the at least partially formed book block.

4. The method according to claim 3, further comprising adhering the supplement on top of the at least partially formed book block.

5. The method according to claim 1, further comprising supplying the supplements from a second printer to an at least partially formed book block.

6. The method according to claim 5, wherein the printer and the second printer are digital printers.

7. The method according to claim 1, further comprising processing the loose book block by one of adhesive binding the book block, spiral binding the book block, wire stitching the book block, or thread stitching the book block.

8. The method according to claim 1, wherein the step of supplying the at least one supplement comprises supplying the at least one supplement from a digital printer to the at least partially formed book block.

9. A device to produce printed items having at least one printed product and a supplement, comprising:

a gathering device with a gathering section, the gathering section including a continuously circulating conveyor;

a printer to produce the printed products, the printed products including a single page or partial block stacks;

feeders to supply the printed products to the conveyor, and at least one supplement feeder arranged between two of the feeders to feed at least one supplement to the circulating conveyor.

10. The device according to claim 9, wherein the continuously circulating conveyor includes uniformly spaced apart receiving locations which move past the feeders, the receiving locations receiving the single pages, partial block stacks, and the at least one supplement.

11. The device according to claim 9, further comprising a diverter to supply the single page or partial block stacks to the feeders.

12. The device according to claim 9, wherein the single page or partial block stacks are supplied along separate conveying paths to the feeders.

13. A method to produce printed items having at least one printed product and supplement, comprising:

printing the at least one printed product with a printer, the printed products each including a single page or partial block stacks;

feeding the printed products from the printer with feeders to a circulating conveyor, supplying a supplement with at least one supplement feeder arranged between two of the feeders to the circulating conveyor, and selectively gathering the printed products and supplement along the gathering section to form loose book blocks.

* * * * *